US008173927B2

(12) United States Patent
Treier

(10) Patent No.: US 8,173,927 B2
(45) Date of Patent: May 8, 2012

(54) HIGH AND MEDIUM VOLTAGE SWITCH APPARATUS WITH TWO INTERRUPTERS, HAVING COMMON MEANS FOR ACTUATING THE MOVABLE CONTACTS OF THE INTERRUPTERS

(75) Inventor: Lukas Treier, Holziken (CH)

(73) Assignee: Areva T&D AG, Oberentfelden (CH)

( * ) Notice: Subject to any disclaimer, the term of this patent is extended or adjusted under 35 U.S.C. 154(b) by 314 days.

(21) Appl. No.: 12/576,723

(22) Filed: Oct. 9, 2009

(65) Prior Publication Data

US 2010/0089875 A1 Apr. 15, 2010

(30) Foreign Application Priority Data

Oct. 14, 2008 (FR) ..... 08 56946

(51) Int. Cl.
*H01H 33/02* (2006.01)

(52) U.S. Cl. ..... 218/154; 218/7; 218/14

(58) Field of Classification Search ..... 218/2–14, 218/43–45, 78, 84, 153, 154; 200/400, 401, 200/500, 501
See application file for complete search history.

(56) References Cited

U.S. PATENT DOCUMENTS

| | | | | |
|---|---|---|---|---|
| 6,437,269 | B1 * | 8/2002 | Rakus | 200/400 |
| 6,545,241 | B1 | 4/2003 | Franchi et al. | |
| 6,603,087 | B2 * | 8/2003 | Osterholm et al. | 218/12 |
| 7,692,113 | B2 * | 4/2010 | Meinherz | 218/43 |

FOREIGN PATENT DOCUMENTS

| | | | |
|---|---|---|---|
| CH | 696476 | A5 | 6/2007 |
| DE | 19602912 | A1 | 7/1997 |
| DE | 10205334 | C1 | 11/2003 |
| EP | 0735637 | A2 | 10/1996 |
| EP | 1082791 | B1 | 4/2005 |
| FR | 2744284 | A1 | 8/1997 |
| WO | 0024099 | A1 | 4/2000 |

OTHER PUBLICATIONS

French Search Report, FR 0856952, dated May 13, 2009.
French Search Report, FR 0856946, dated May 13, 2009.
U.S. Appl. No. 12/577,059, filed Oct. 9, 2009.

* cited by examiner

*Primary Examiner* — Renee Luebke
*Assistant Examiner* — Marina Fishman
(74) *Attorney, Agent, or Firm* — Nixon Peabody LLP

(57) ABSTRACT

To control a switch apparatus having two interrupters, such as a busbar disconnector and a grounding disconnector, there is provided a rotary control shaft arranged away from, and at right angles to, the planes of straight line motion of the movable contacts, at least one disk cam fastened to the control shaft and having two distinct internal cam grooves, and two pairs of levers hinged to each other. One of the levers has one end hinged at a fixed point while its other end is hinged to the other lever, which is itself hinged to one of the movable contacts, a spigot being located between the two ends of each of the levers that has one end hinged at a fixed point, the spigot being engaged in one of the cam grooves so as to constitute a cam follower.

12 Claims, 3 Drawing Sheets

HIGH AND MEDIUM VOLTAGE SWITCH APPARATUS WITH TWO INTERRUPTERS, HAVING COMMON MEANS FOR ACTUATING THE MOVABLE CONTACTS OF THE INTERRUPTERS

TECHNICAL FIELD

This invention relates in general terms to the field of high or medium voltage switch apparatus having at least one interrupter.

In particular, the invention is concerned with apparatus of this type in which at least one of the interrupters is a busbar disconnector and at least one of the interrupters is a grounding disconnector.

More specifically, the invention relates to said type of switch apparatus in which each disconnector comprises a pair of contacts that consist of a stationary contact and a contact that is movable in straight line motion, for the purpose of separating from each other during a switching operation.

The main application is medium or high voltage switchgear in which the busbar disconnector and grounding disconnector are disposed inside insulating casings, each of which is filled with a dielectric gas under protective atmosphere such as $SF_6$.

PRIOR ART

The mechanical operations performed in this type of apparatus are commonly independent, being carried out by two separate mechanical control units that are controlled by mechanical or electrical interlocking devices.

These interlocking devices, the purpose of which is to ensure the safety of personnel and equipment, operate by permitting the position of the busbar disconnector to be held open while the grounding disconnector is in its closed state, since the grounding disconnector must not be closed when there is a voltage on the main circuit.

It has in the past been proposed to actuate each movable contact of two separate interrupters, such as a busbar disconnector and a grounding disconnector, by means of a single rotary control shaft. In particular, it is known to actuate two movable contacts in straight line motion by means of a single rotary shaft.

The document WO 0024 099, in an embodiment shown in FIG. 8 (the description of which is given at page 12 line 18 to page 13 line 18), teaches a high voltage switch apparatus with two busbar disconnectors and one grounding disconnector, with common actuator means. In that document, the interrupters 136, 137, and 138 have their respective movable contacts 58, 65, and 64, each of which comprises an element 135 that constitutes a follower with straight line motion, in contact with a peripheral surface of an element that constitutes a common disk cam 130, which is fastened to a rotary control shaft 123. In addition, in order to bring the current from a conductor 54 to each of the stationary contacts 55, 56, and 57, the peripheral surface of the cam 130 is conductive. The disadvantages of the switch apparatus of that document are numerous. First of all, the movable contacts 58, 65, and 64 are not necessarily guided in both directions of their straight line motion (that is to say the opening and closing directions). That kind of switch apparatus calls for a large amount of space. Moreover a high torque is required, firstly because of the small amount of angular movement that is possible for the cam 130 in order to displace the movable contact 58, 65, or 64, and secondly because of the force of the return spring that surrounds the movable contact, and that adds to the force applied between the movable contact and the cam 130.

The document CH 696476 also teaches a switch apparatus 1, which has two interrupters 2 and 3 in which the two contacts 4 and 6, movable in straight line motion, are hinged, each at a point 13, 14 that constitutes a follower oscillating in a single groove 12 of a common disk cam 9, which is fastened to a rotary control shaft 10. The disadvantages of the switch apparatus disclosed in that document are numerous. A high rotational torque is needed on the shaft 10 near the closing positions, due to the axial force that is required for the large movable contact, and due to the distance of this movable contact from the axis of rotation 10. The actuating force is applied directly to the movable contact, which generates lateral forces on that contact. The disk cam 9 must be designed to be quite wide because it needs to be greater than the distance moved by the movable contacts and 6. The axis of rotation of the disk cam 9 is arranged at the intersection of the movement axes of the contacts 4 and 6. The space required for a given apparatus is large because the disk cam projects outside the angular zone having a smaller angular extent, which zone is defined by the axes of the straight line motion of the movable contacts 4 and 6.

The document DE 196 02 912 describes a controller with a lever 17 having two arms 15 and 29. One of the arms, 15, is coupled to a single movable contact 12, while the other arm 19 is coupled to a control mechanism. That control mechanism comprises a spring controller with a single spiral spring 32 and a disk cam 22. The spring controller sets the disk cam 22 in rotation in both directions. The disk cam 22 is coupled to the other arm 19 of the lever 17.

The structures of the switch apparatuses taught in the documents discussed above all have the disadvantage that they give rise to a reaction force on the rotary shaft when the movable contacts are in the closed position, that is to say when they are in mutual engagement with their corresponding stationary contacts. In other words, undesirable loads are applied to the rotary shaft and to the actuator situated upstream that causes the shaft to rotate.

An object of the invention is to mitigate, wholly or partly, the disadvantages of the control mechanisms of the switch apparatuses that are known at the present time and that have at least two interrupters, such as disconnectors, with actuator means common to the movable contacts.

More especially, an object of the invention is to propose a control mechanism for a switch apparatus of the type set forth above, with common actuator means that optimize the transmission of force between firstly a rotary control shaft, and secondly each of the contacts movable in straight line motion.

In particular, an object of the invention is to propose a control mechanism for a switch apparatus of the type mentioned above, with common actuator means having a variable drive ratio (i.e. the ratio between the distance moved in a straight line by a movable contact and the angular distance moved by the rotating control shaft) this ratio having its lowest value in proximity to the closed position of the disconnector concerned.

A further particular object of the invention is to propose a control mechanism for a switching apparatus of the type set forth above, with common actuator means, such that the maximum torque exerted on the rotary control shaft is low, and also such that the axial forces in the axis of the straight line motion of the movable contacts are similarly low.

Yet another object of the invention is to propose a control mechanism for a switch apparatus of the type set forth above, with common actuator means of small size that are easy to assemble.

SUMMARY OF THE INVENTION

With this in view, the invention provides a control mechanism for a high or medium voltage switch apparatus that comprises at least two interrupters, each of which has a pair of contacts that consists of a stationary contact and a contact movable in straight line motion for separation of the contacts from each other in a switching operation, wherein the control mechanism comprises:

common actuator means for actuating the movable contact and arranged to permit closing of one of the interrupters while keeping the other interrupter open and vice versa, the common actuator means comprising:

a rotary control shaft disposed at right angles to the axes of the straight line motion of the movable contacts; and at least one disk cam fastened to the control shaft and having two distinct internal cam grooves;

two pairs of levers hinged together, one of the levers of a given pair being a fixed-end lever in that it has one end hinged at a fixed point, its other end being hinged to the other lever of said given pair, said other lever being itself hinged to one of the movable contacts, with a spigot being disposed between the two said ends of each fixed end lever, said spigot being engaged in one of the cam grooves so as to constitute a follower; the geometry, length, and disposition of said two pairs of levers of the mechanism, and the profiles of the cam grooves, being such as to afford an additional drive ratio between the disk cam or cams and each associated movable contact.

The expression "additional drive ratio between the disk cam or cams and each associated movable contact" is to be understood to mean herein, and within the context of the invention, a drive ratio (as defined above) that supplements that of the drive in which the movable contact is directly hinged to a groove of a disk cam, as is for example shown in the document CH 696 476.

Because of this additional ratio, the radius of the disk cam can be reduced.

By suitable choice of the length of the grooves, the transmission ratio between the movable contact and the disk cam can therefore be optimized so that it will be:

high during the course of the straight line movement between stationary contacts (that is to say the stationary contact that is secured to the metal casing in which the movable contact is mounted, and the stationary closing contact); and low when the movable contact is close to or in its closed position (that is to say when it is fully engaged in the stationary closing contact).

Compared with the disk cam transmission taught by the patent CH 696 476, the invention, as defined herein, has the following advantages:

no transverse force is applied to the movable contacts;

an additional drive ratio is obtained by virtue of the levers;

the radius of the disk cam does not of necessity have to be greater than the amount of movement of the movable contacts, and the outside dimensions of the disk cam are reduced;

a variable transmission ratio, with the transmission force being at its lowest in proximity to the closed position of the contacts, which reduces the torque needed on the control shaft;

a substantially zero transmission ratio in proximity to the end positions of each interrupter, which enables the contacts to be self-braking in their end positions and therefore avoids any reaction on the control shaft and the use of a specific actuator dedicated to this braking function; and reduced space requirement because of the arrangement of the control shaft in the angular zone that is defined by the axes of the straight line movement of the movable contacts.

The profile of the grooves is preferably such that the follower is in end stop engagement against the groove at, or immediately after, the dead-center point in the closed position.

In an advantageous modified embodiment, each said cam groove consists of a portion of circular profile, the center of which is the axis of rotation of the control shaft, together with a portion having a profile of varying distance from the axis of rotation of the control shaft, one of said followers being engaged in said second portion of a cam groove, while the other follower is engaged in said circular first portion of the other groove, so as to keep one of the interrupters open while the other interrupter is being closed and vice versa (i.e. with 20 open and 21 closed), and so as also to avoid any reaction force on the control shaft from a movable contact in its closed position.

The axis of rotation of the control shaft and the disk cam are preferably disposed in the smallest angular zone defined by the axes of the straight line motion of the contacts.

Each said lever of a given pair in which one end of that lever is hinged at a fixed pivot point, its other end being coupled to a said movable contact may with advantage be arranged between the control shaft and the axis of the straight line motion of the movable contact with which it is not coupled.

Advantageously, a roller is mounted for rotation on said spigot. In this way the friction forces between the spigot and the corresponding cam groove are reduced.

In this version, the circular portions of the cam grooves are concentric with each other and situated on a common angular disk cam portion.

In an advantageous embodiment, there is one said disk cam per interrupter, the two disk cams being arranged parallel to each other on the rotary control shaft, and being spaced apart by a distance substantially equal to the sum of the thickness of two said levers and a free space for permitting them to perform frictionless relative movement. This version calls for an axial size, that is to say the dimension in the direction of the rotary control shaft, greater than in the version that has only a single disk cam. This version with two parallel disk cams has the advantage that it enables a reduction to be made in the diameter of each disk cam and it gives more freedom of choice as to the arrangement of the grooves on the cams.

In this embodiment, each said fixed-end lever consists of two identical members arranged parallel to each other in such a way that each disk cam is displaceable between two said members that are parallel to each other.

The invention also provides a medium or high voltage gas insulated switch having, at least for one phase, a switch apparatus including a casing in which are mounted, at least partially, movable contacts of two interrupters, such as a busbar disconnector and a grounding disconnector, and a control mechanism such as is set forth above.

The movable contacts may advantageously be of hollow tubular form in order to improve the cooling of each said apparatus during a switching operation.

In another version, the switch has, for each of the three phases a switch apparatus including a casing in which there are mounted, at least partially, the movable contacts of two interrupters, such as a busbar disconnector and a grounding disconnector, and a control mechanism such as is set forth above, with a control shaft that is made in one piece, that is coupled to an actuator, and that couples the three casings together.

Alternatively, for each of the three phases, the switch has a switch apparatus including a casing in which there are mounted, at least partially, the movable contacts of two interrupters, such as a busbar disconnector and a grounding disconnector, and a control mechanism such as is set forth above, with a control shaft in three separate parts, one said part being coupled to an actuator, and each of the other two parts coupling together two adjacent disk cams.

BRIEF DESCRIPTION OF THE DRAWINGS

Features and advantages of the invention can be understood more clearly on a reading of the following detailed description, which is given by way of example only and with reference to the accompanying drawings.

In the drawings.

DETAILED DESCRIPTION OF PARTICULAR EMBODIMENTS

The figures described below show a switch apparatus 2A that conforms with the invention and carries out switching operations on a single pole. It goes without saying that the arrangement of a switch apparatus described below may be repeated for each pole in a multi-pole combination.

Figure 1:
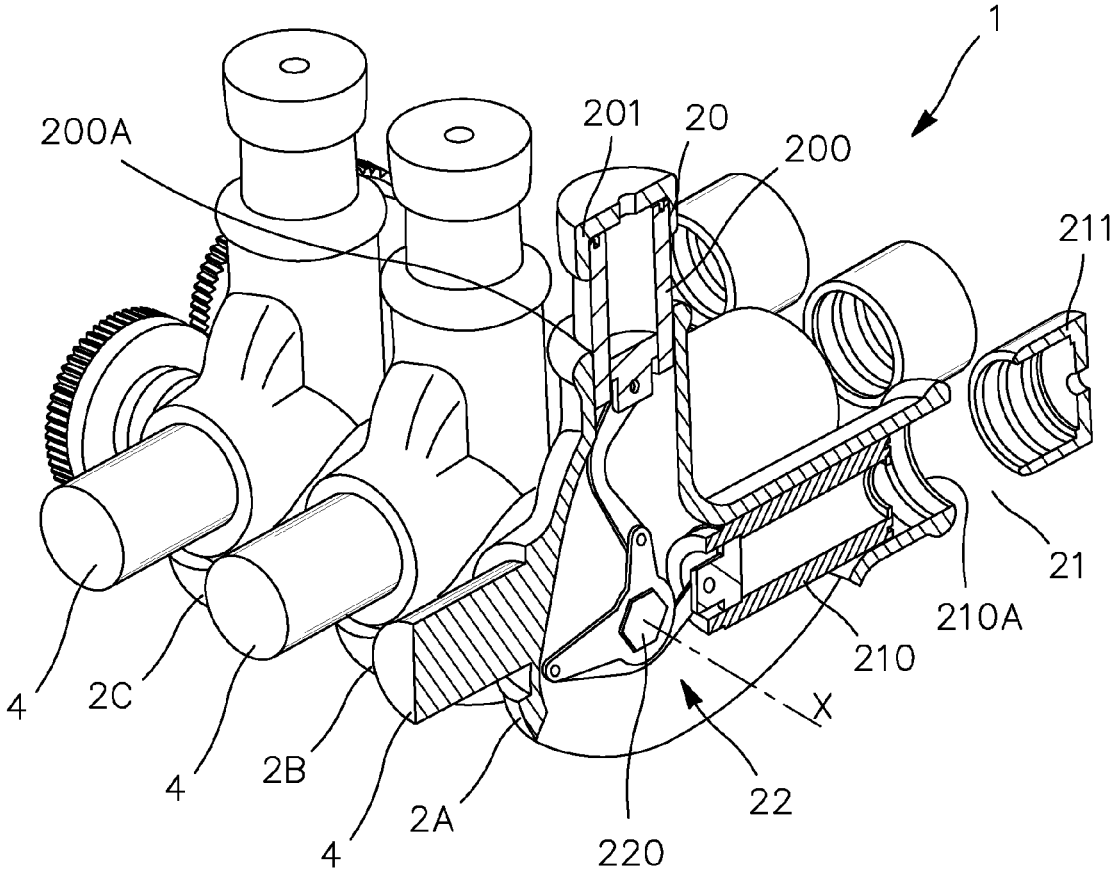
FIG. 1 is a perspective view of part of a gas insulated switch (GIS) of the invention.

FIG. 1 shows part of a three-phase switch 1 having three identical casings 2A, 2B, 2C, in each of which a switch apparatus that conforms with the invention is lodged. These three identical phases are arranged inside a common metal casing (not shown), and are fastened to an insulating plate by the conductors 4 (see FIG. 2). In addition, an insulating bar 5, fastened to the three identical casings 2A, 2B, and 2C, is provided to give mechanical strengthening.

In the embodiments shown in FIGS. 1 to 5, the grounding disconnector 20 and the busbar disconnector 21 of one of the phases, 2A, are arranged substantially in a common plane and define an angle of 90° between them. It goes without saying that the arrangement of the grounding disconnector 20 in relation to the busbar disconnector 21 may be different: it may be such that the two disconnectors define between them an angle in the range between 70° and 180°.

The movable contacts 200 and 210 of one phase and the actuator means 22 (also referred to as force transmitting means) of one phase are arranged in a common casing 2A. Each movable contact 200, 210 slides in an opening 200A, 210A respectively, formed in the casing 2A for that purpose. Each of the stationary contacts 201 of the grounding disconnector is fastened to the inside of the common metal casing that is not shown. Each of the stationary contacts 211 of the busbar disconnectors is fastened to a conductor that is, again, not shown.

Such an arrangement of the movable contacts 200 and 210 and actuator means 22 enables the reaction forces to be withstood by the same casing 2A, 2B, or 2C, which limits the maximum reaction forces applied from outside. The casing acts as an electrical sheath for the live elements (i.e. those under voltage), which increases the dielectric resistance and reduces partial discharges. The casing also acts as a conductive element for transmitting the current from each conductor to the movable contacts. In addition, the casing contributes to the evacuation of heat by thermal conduction from the movable contacts 200 and 210 to a surrounding zone.

In all of the embodiments seen in the drawings, the movable contacts 200 and 210 as shown are in the form of hollow cylinders of revolution open at both ends. They are arranged inside the corresponding casing in their open position, the advantage of which lies in good dielectric performance. The movable contacts 200 and 210 are brought into the casing in their open position.

The stationary contacts, or electrodes, 201 and 211 are in the form of hollow cylinders of revolution, but they are open only on that side which faces towards the corresponding movable contact 200 or 210. In the practice of this invention, the proximity of the closed position of a movable contact of a given interrupter, whether it be the grounding disconnector or the busbar disconnector, corresponds to insertion, at least partially, of the movable contact 200 or 210 into the corresponding stationary contact 201 or 211.

Each switch apparatus (i.e. each phase), with its casing 2A, 2B, or 2C, its movable contacts 200 and 210 and a portion of its actuator means 22 common to the movable contacts (lever, connecting rod) may be assembled beforehand, so reducing the costs of manufacture.

In all of the embodiments shown in the drawings, the common actuator means 22 for the movable contacts 200 and 210 enable the grounding disconnector 20 to be closed while keeping the busbar disconnector 21 open, and vice versa. The fact that the movable contacts 200 and 210 do not move into their open position results in a saving of space for the casing 2A, 2B, or 2C.

The rotary control shaft 220 is arranged away from, and at right angles to, the two axes of the straight line motion of the movable contacts 200 and 210, in an angular sector that is situated between the two axes, for example making an angle of 90° between them. The shaft 220 is carried by each metal casing 2A, 2B, or 2C at least one end, and its rotation is controlled by an actuator arranged outside the casings 2A, 2B, and 2C.

Figure 2:
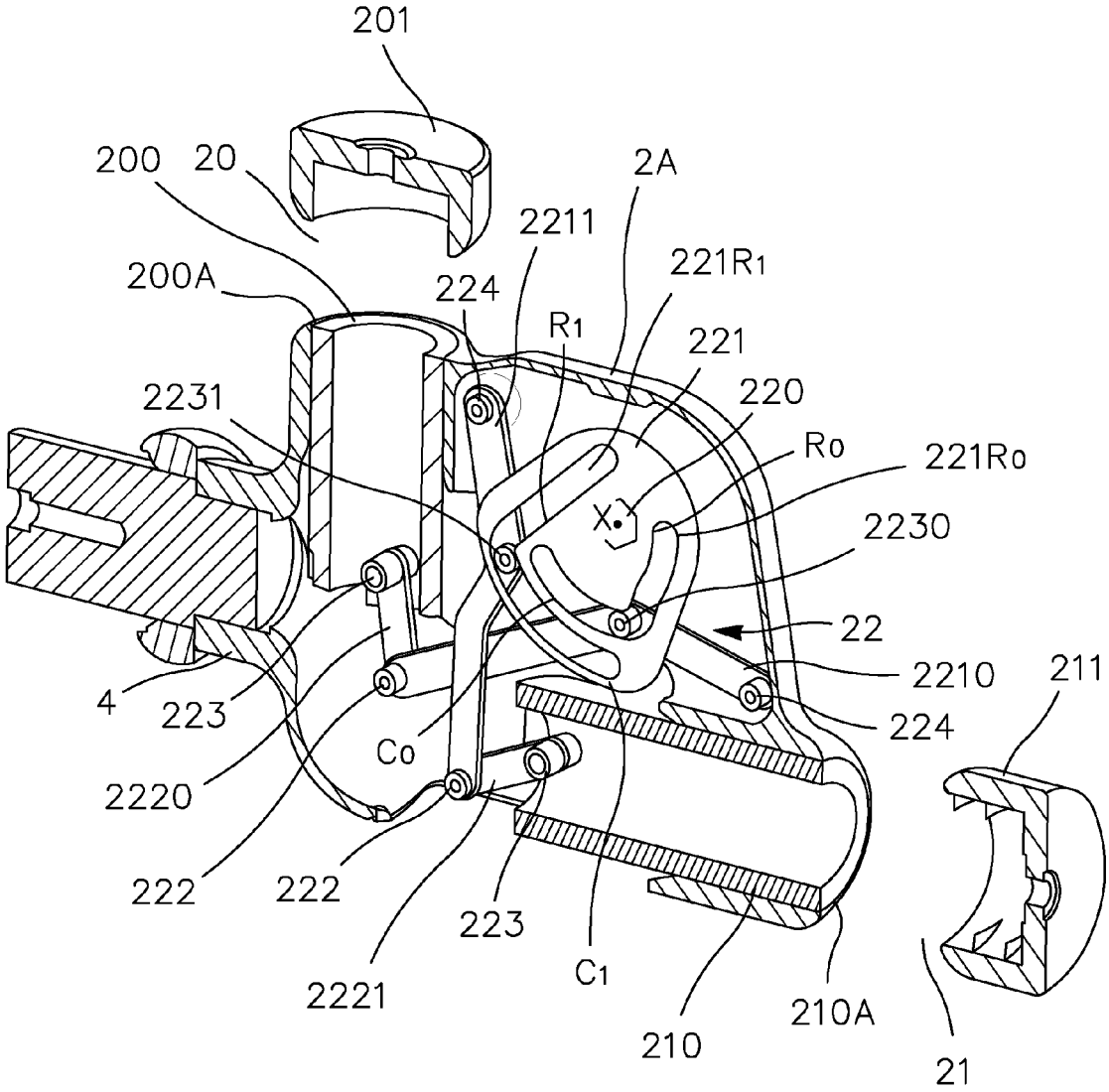
FIG. 2 is a view in cross section of one version 2A of the switch apparatus of the invention, the apparatus being shown in an interruption position (with opening of the busbar disconnector and grounding disconnector)
Figure 3:
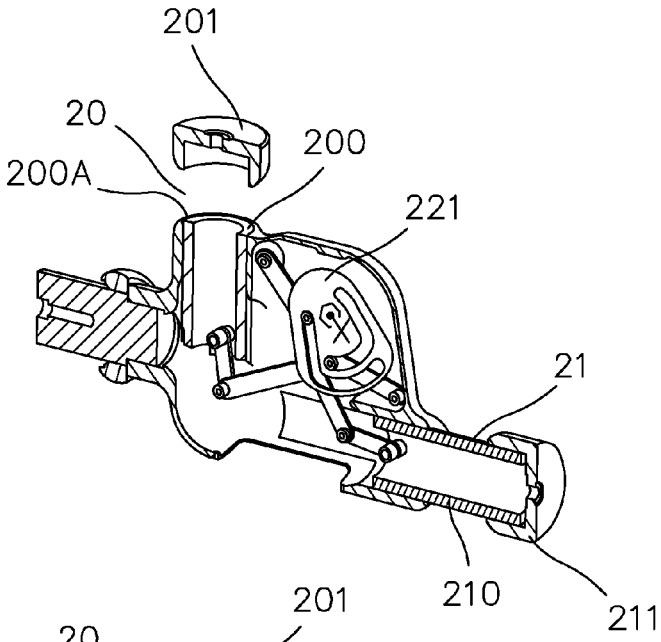
FIG. 3 is a view in cross section of the same embodiment as that shown in FIG. 2, with the apparatus in an operational position (closing of the busbar disconnector)
Figure 4:
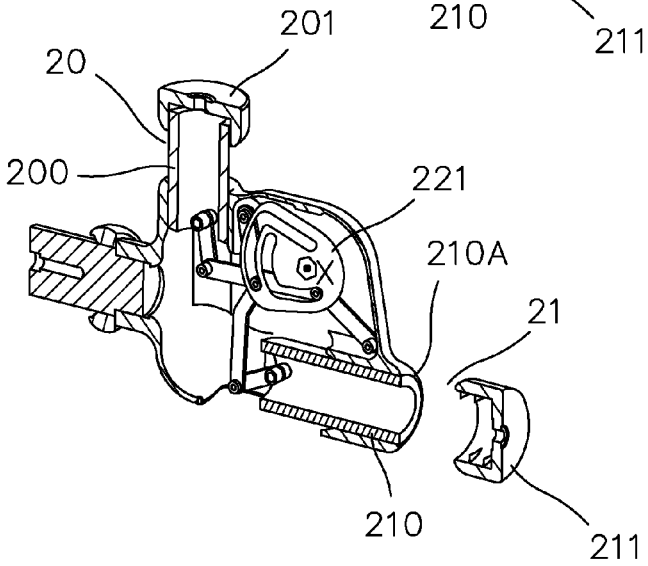
FIG. 4 is a view in cross section of the same embodiment as that shown in FIG. 2, with the apparatus in a grounding position (with the grounding disconnector closed)

In a first embodiment, shown in FIGS. 2 to 4, the common actuator means 22 comprise a control shaft 220 on which a single disk cam 221 is fixed. This cam has two grooves $\mathbf{221}_{R0}$ and $\mathbf{221}_{R1}$. The actuator means further include two pairs of levers 2210, 2220 and 2211, 2221. The levers 2210, 2220 and 2211, 2221 of a given pair are hinged together at a pivot point 222. Each of the two levers 2210 and 2211 is also hinged to the metal casing 2A at a fixed pivot point 224. As to the levers 2220 and 2221, each of these is hinged to the corresponding movable contact 200 or 210 at a pivot point 223. The mechanical drive (actuating) coupling between each lever 2210 or 2221 fastened to the metal casing 2A and one of the grooves of the cam 221, i.e. the cam grooves $\mathbf{221}_{R0}$ and $\mathbf{221}_{R1}$ respectively, is made by means of a spigot 2230, 2231 fixed on said lever. It is of advantage to have a roller mounted rotatably on each of the spigots 2230 and 2231.

Each spigot 2230 or 2231, preferably carrying its roller, therefore acts as a cam follower for the cam 221.

In the practice of this invention, the geometry, the length and the disposition of the two pairs of levers 2210, 2220 and 2211, 2221 within the metal casing 2A, and the profiles of the cam grooves $\mathbf{221}_{R0}$ and $\mathbf{221}_{R1}$ of the cam 221, enable there to be an additional drive ratio (actuating ratio) between the cam 221 and each associated movable contact 200, 210.

In other words, as compared with an actuating mechanism common to two interrupters as found in the prior art, in which each movable contact is hinged directly to the interior of a cam groove as described in the Patent CH 696 476, the common actuating mechanism of this invention enables the following features to be obtained:

- a transmission ratio that is variable and that is also optimized as a function of the position of the movable contacts relative to the associated stationary contacts; and
- a reduction in the diameter of the disk cam for a given amount of displacement of the movable contacts. In this way, the mechanism shown in FIGS. 1 to 5 affords:
- a high transmission ratio when the movable contacts 200 and 210 are between the opening stationary contact and the closing stationary contact respectively, that is to say between the stationary contacts 200A and 201 for the movable contact 200, and between the stationary contacts 210A and 211 for the movable contact 210;
- a low transmission ratio when the movable contact 200 or 210 is close to the interrupter 20 or 21, that is to say when the movable contact 200 or 210 is engaged at least partially in the corresponding stationary contact 200 or 211; and
- a reduced space requirement due to the arrangement of the control shaft 220 in the angular zone defined by the axes of the straight line motion of the movable contacts 200 and 210.

The actuating torque to be applied to the control shaft 220 in order to displace the movable contacts 200 and 210 is small.

The common actuating mechanisms 22 in the embodiments shown in the drawings have the further advantage that they have a zero or substantially zero transmission ratio when the movable contact 200 or 210 is completely engaged in the corresponding stationary contact 201 or 211. This zero transmission ratio is obtained as a result of the amount of displacement of the movable contact defined by the length and profile of the cam groove 221.

Thus, each movable contact 200, 210 is, as it were, self-braking (blocking) in its closed position. Therefore no undesirable reaction force that may occur, as a result for example of high current or vibrations, is able to be transmitted to the control shaft 220 when one of the movable contacts 200 and 210 is in its closed position (see FIGS. 3 and 4).

In addition, each of the cam grooves $\mathbf{221}_{R0}$ and $\mathbf{221}_{R1}$ has a portion C0, C1 with a circular profile, the center of which is the axis of rotation X of the control shaft, together with a portion R0, R1 that is so profiled that there is a varying distance between this portion and the axis of rotation X. At the end of the portion R0 or R1 having a straight profile that is remote from the portion C0 or C1 having the curved profile, the cam grooves have a short portion in which the distance of this short portion from the axis of rotation X is constant, so that there is a zero transmission ratio in the closed position of the contacts.

One of the cam followers, 2230 or 2231, is engaged in the straight portion R0 or R1 of one cam groove, while the other follower, 2231 or 2230, is engaged in the circular portion C1 or C0 of the other cam groove, so as to keep the grounding disconnector 20 open while the busbar disconnector 21 is being closed, and vice versa.

As shown, the circular portions C0 and C1 of the cam grooves are concentric with each other, and are situated on a common angular portion of the cam disk 221.

Figure 5:
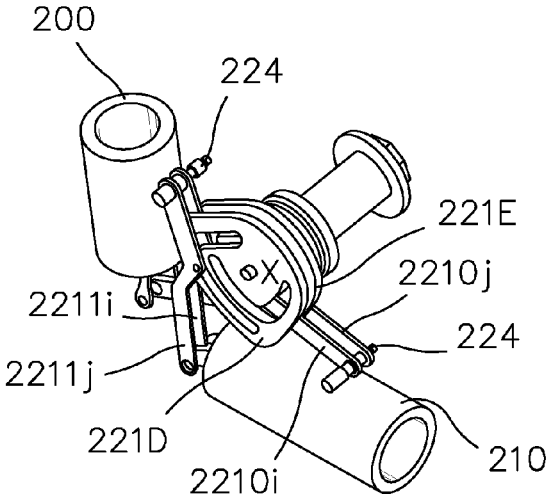
FIG. 5 is a perspective diagram of one version 2A of a portion of a switch apparatus of the invention, with the apparatus in an interruption position (opening of both the busbar disconnector and the grounding disconnector).

FIG. 5 shows another embodiment, in which one disk cam 221D, 221E is provided for each of the disconnectors 20 and 21. The two disk cams $\mathbf{221}_D$ and $\mathbf{221}_E$ are arranged, in this example, parallel to the rotary control shaft 220, from which they are spaced away by a distance substantially equal to the thickness of two levers 2210*i*, 2211*i*, augmented by the width of a free space to enable the cams to rotate without any frictional contact between them.

In FIG. 5, each lever 2210, 2211, with one end at a fixed point 224, comprises two identical lever members 2210*i*, 2210*j* or 2211*i*, 2211*j*, which are arranged parallel to each other in such a way that each disk cam 221D or 221E is displaced between the two lever members parallel to each other.

This embodiment shown in FIG. 5 has essentially the advantage that it enables the diameter of the disk cam to be reduced, and gives greater freedom of choice as to the arrangement of the cam grooves. It does however make necessary a greater axial dimension to accommodate the control shaft 220 than in the version seen in FIGS. 2 to 4.

In the embodiments shown, the cam grooves $\mathbf{221}_{R0}$ and $\mathbf{221}_{R1}$ are made so that they are open on either side of the disk cam or cams 221. They can be made blind, that is to say open on only one side of the disk cam or cams. As compared with gas insulated switches (GIS) as known up to the present, the invention just described offers the following advantages:

- compact dimensions of the gas insulated switch, with little distance between the phases 2A, 2B, and 2C;
- the transmission ratio for each busbar disconnector or grounding disconnector of each phase 2A, 2B, or 2C is variable, and is optimized as a function of the position of the movable contacts 200 and 210 relative to the corresponding stationary contact 201,211;
- self-braking of the movable contacts 200 and 210 in their closed position;
- a transmission torque, which may be low, to suit the requirements of the control shaft 200;
- pre-assembly of each phase 2A, 2B, and 2C is possible, with the result that there is good dielectric performance (the dielectric sheathing effect being efficient);
- a reduced space requirement due to the arrangement of the control shaft 220 in the angular zone defined by the axes of the straight line motion of the movable contacts 200 and 210; and
- the surface of the casing 2A beneficially assists the removal of heat from the contacts to their surrounding casings.

In order to optimize cooling of the apparatus, it is of advantage to make the movable contacts in a hollow tubular form. With this form, the insulating gas is able to enter into the interior of the casing through an opening in the base of the casing and then to pass along the contacts, to leave via the interior of the tubular contacts through the top (that is to say cooling is then by chimney effect).

The invention claimed is:

1. A control mechanism for a high or medium voltage switch apparatus that comprises at least two interrupters, each of which has a pair of contacts that consist of a stationary contact and a contact movable in straight line motion for separation of the contacts from each other in a switching operation, wherein the control mechanism comprises:

common actuator means for actuating the movable contacts and arranged to permit closing of one of the interrupters while keeping the other interrupter open and vice versa, the common actuator means comprising:

a rotary control shaft disposed at right angles to the axes of the straight line motion of the movable contacts; and at least one disk cam fastened to the control shaft and having two distinct internal cam grooves;

two pairs of levers hinged together, one of the levers of a given pair being a fixed-end lever in that it has one end hinged at a fixed point and another end hinged to the other lever of said given pair, said other lever being hinged to one of the movable contacts, with a spigot being disposed between said two ends of each fixed end lever, said spigot being engaged in one of the cam grooves so as to constitute a follower; the geometry, length, and disposition of said two pairs of levers of the mechanism, and the profiles of the cam grooves, affording a ratio between the disk cam or cams and each associated movable contact compared to a direct link between said disk cam or cams and said each associated movable contact.

2. A control mechanism for a switch apparatus according to claim 1, wherein each said cam groove consists of a circular first portion, the circular profile of which has a center coincident with the axis of rotation of the control shaft, together with a second portion having a profile of varying distance from the axis of rotation of the control shaft, one of said followers being engaged in said second portion of a cam groove, while the other follower is engaged in said circular first portion of the other groove, so as to keep one of the interrupters open while the other interrupter is being closed and vice versa, and so as also to avoid any reaction force on the control shaft from a movable contact in its closed position.

3. A control mechanism for a switch apparatus according to claim 1, wherein the axis of rotation of the control shaft and the disk cam are disposed in the smallest angular zone defined by the axes of the straight line motion of the contacts.

4. A control mechanism for a switch apparatus according to any preceding claim, wherein each said lever of a given pair in which one end of that lever is hinged at a fixed pivot point and the other end is coupled to said movable contact, is arranged between the control shaft and the axis of the straight line motion of the movable contact with which it is not coupled.

5. A control mechanism for a switch apparatus according to claim 1, wherein a roller is mounted for rotation on said spigot.

6. A control mechanism for a switch apparatus according to claim 2, wherein the circular portions of the cam grooves are concentric with each other and situated on a common angular disk cam portion.

7. A control mechanism for a switch apparatus according to claim 1, having one said disk cam per interrupter, the two disk cams being arranged parallel to each other on the rotary control shaft, and being spaced apart by a distance substantially equal to the thickness of two said levers.

8. A control mechanism for a switch apparatus according to claim 7, wherein each said fixed-end lever consists of two identical members arranged parallel to each other in such a way that each disk cam is displaceable between two said members that are parallel to each other.

9. A medium or high voltage gas insulated switch having, at least for one phase, a switch apparatus including a casing in which are mounted, at least partially, movable contacts of two interrupters, such as a busbar disconnector and a grounding disconnector, and a control mechanism according to claim 1.

10. A gas insulated switch according to claim 9, wherein the movable contacts are of hollow tubular form in order to improve the cooling of each said apparatus during a switching operation.

11. A gas insulated switch according to claim 9, having, for each of the three phases a switch apparatus including a casing in which are mounted, at least partially, movable contacts of two interrupters, such as a busbar disconnector and a grounding disconnector, and with a control shaft of the control mechanism made in one piece, that is coupled to an actuator and that couples the three casings together.

12. A gas insulated switch according to claim 9, having, for each of the three phases a switch apparatus including a casing in which are mounted, at least partially, movable contacts of two interrupters, such as a busbar disconnector and a grounding disconnector, and with a control shaft of the control mechanism in three separate parts, one said part being coupled to an actuator, and each of the other two parts coupling together two adjacent casings.

* * * * *